US007938556B2

(12) United States Patent
Dahlin

(10) Patent No.: US 7,938,556 B2
(45) Date of Patent: May 10, 2011

(54) TORCH

(75) Inventor: Flemming Dahlin, Graested (DK)

(73) Assignee: Wiseled APS (DK)

( * ) Notice: Subject to any disclaimer, the term of this patent is extended or adjusted under 35 U.S.C. 154(b) by 366 days.

(21) Appl. No.: 12/066,306

(22) PCT Filed: Sep. 11, 2006

(86) PCT No.: PCT/DK2006/000501
§ 371 (c)(1),
(2), (4) Date: Apr. 30, 2008

(87) PCT Pub. No.: WO2007/028397
PCT Pub. Date: Mar. 15, 2007

(65) Prior Publication Data

US 2008/0225516 A1 Sep. 18, 2008

(30) Foreign Application Priority Data

Sep. 9, 2005 (DK) ..... 2005 01264

(51) Int. Cl.
*F21L 4/02* (2006.01)
*F21V 29/00* (2006.01)

(52) U.S. Cl. ..... 362/184; 362/158; 362/205; 362/373

(58) Field of Classification Search ..... 362/158, 362/184, 398, 294, 373, 249.02, 249.06, 362/202, 205, 208, 249.05, 230, 249.12, 362/249.13, 249.14
See application file for complete search history.

(56) References Cited

U.S. PATENT DOCUMENTS

| | | | | |
|---|---|---|---|---|
| 1,875,956 | A | 9/1932 | Thiel | |
| 3,299,262 | A | 1/1967 | Duncan | |
| 3,792,389 | A | 2/1974 | Murphy | |
| 4,428,033 | A | 1/1984 | McBride | |
| 5,034,847 | A * | 7/1991 | Brain | 362/205 |
| 5,752,761 | A * | 5/1998 | Pietruczynik et al. | 362/84 |
| 6,062,702 | A | 5/2000 | Krietzman | |
| 6,357,893 | B1 | 3/2002 | Belliveau | |
| 7,186,000 | B2 * | 3/2007 | Lebens et al. | 362/184 |
| 7,204,606 | B2 * | 4/2007 | Brass et al. | 362/231 |
| 7,281,815 | B1 | 10/2007 | Gustafson et al. | |

(Continued)

FOREIGN PATENT DOCUMENTS

DE 29600847 3/1996

(Continued)

*Primary Examiner* — Thomas M Sember
(74) *Attorney, Agent, or Firm* — Gifford, Krass, Sprinkle, Anderson & Citkowski, P.C.

(57) ABSTRACT

The present invention provides a compact portable light source capable of providing powerful light as well as effect light and is especially suitable for professional use, i.e. for security, police and military use. The invention relates to a portable torch having a plurality of light emitting diodes and a heat sink, namely a portable torch (1) comprising a case (2) having a first and a second open ends, a first cap (3) covering the first open end and a second cap (4) covering the second open end, said first cap having a transparent area (6), illumination means having a diode area (11) comprising a plurality of light emitting devices (LEDs) arranged to emit light out of the first open end and through the transparent area (6) of the first cap (3), a heat sink (14) arranged to transport heat from the light emitting devices, a power source comprising a battery holder and means (7) for activating said power source operatively associated with said case (2).

38 Claims, 24 Drawing Sheets

U.S. PATENT DOCUMENTS

| | | | |
|---|---|---|---|
| 2003/0048599 | A1 | 3/2003 | Martin |
| 2003/0189826 | A1 | 10/2003 | Yoon |
| 2005/0174782 | A1 | 8/2005 | Chapman |
| 2005/0285547 | A1 | 12/2005 | Piepgras et al. |
| 2007/0058366 | A1 | 3/2007 | West |
| 2008/0106891 | A1 | 5/2008 | Lee |

FOREIGN PATENT DOCUMENTS

| | | | |
|---|---|---|---|
| EP | 1528315 | | 5/2005 |
| FR | 1180419 | | 6/1959 |
| FR | 2788328 | A1 | 7/2000 |
| WO | WO-2004107457 | | 12/2004 |
| WO | WO-2007028397 | A2 | 3/2007 |

* cited by examiner

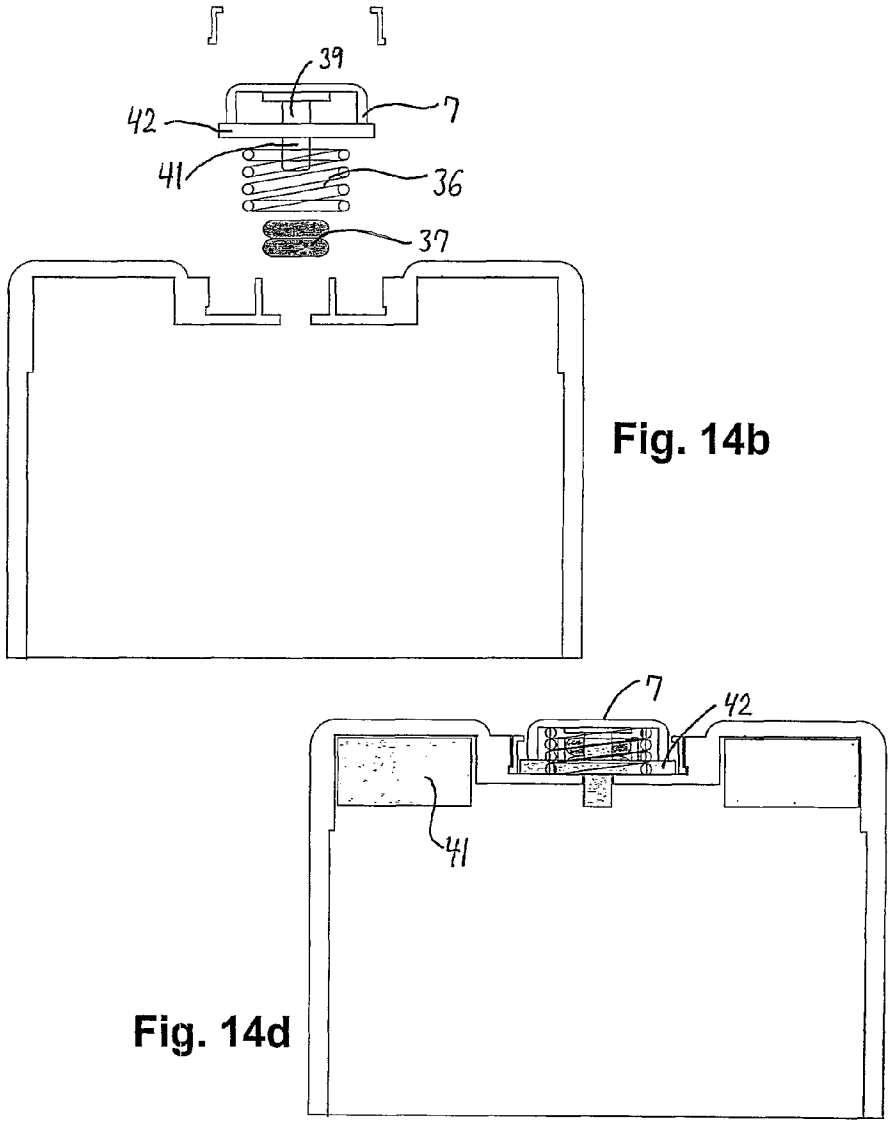
Fig. 14b
Fig. 14d
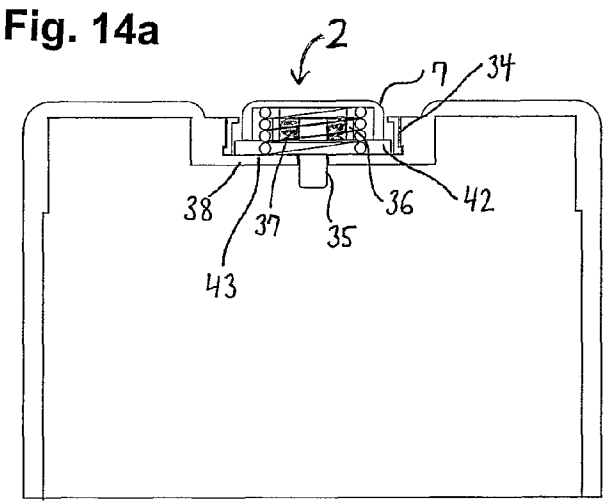
Fig. 14a
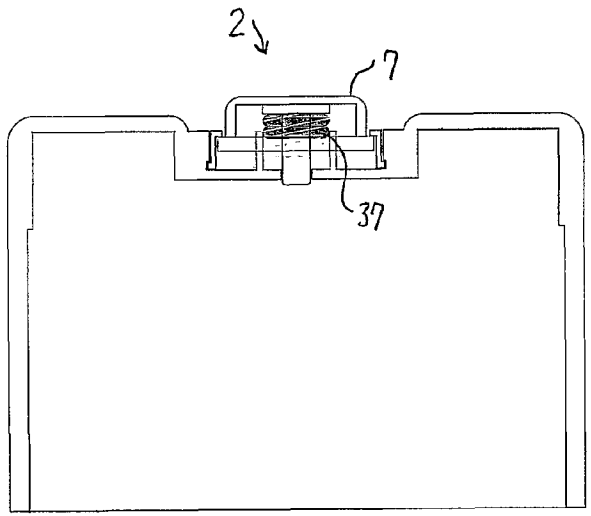
Fig. 14c

TORCH

All patent and non-patent references cited in the present application, are also hereby incorporated by reference in their entirety.

FIELD OF INVENTION

The present invention relates to an illumination apparatus and improved light emitting diode lamp (LED) having a unique configuration. Furthermore, the invention relates to an illumination apparatus capable of functioning as a tank for other battery-driven devices.

BACKGROUND OF INVENTION

A flashlight usually is used by families for emergency occasions or by maintenance personnel to work on a dark working site or military personnel, policemen or even security guards. Especially for professional use it is relevant that the flashlight provides an effectful lightbeam having a long-distance visibility as well as being waterproof and easy to handle.

SUMMARY OF INVENTION

The present invention provides a compact, portable light source, preferably sized to be readily hand-held, for illuminating an object, several objects, or areas for human use and/or machine operation. The portable light source is capable of providing powerful light as well as effect light as discussed below and is especially suitable for professional use, i.e. for security, police and military use.

Accordingly, in one aspect the present invention relates to a portable torch having a plurality of light emitting diodes and a heat sink, namely a portable torch comprising

- a case having a first and a second open ends, a first cap covering the first open end and a second cap covering the second open end, said first cap having a transparent area,
- illumination means having a diode area comprising a plurality of light emitting devices (LEDs) arranged to emit light out of the first open end and through the transparent area of the first cap,
- a heat sink arranged to transport heat from the light emitting devices, wherein said heat sink preferably comprises a central part of a first material, and at least one peripheral part of a second material, and said first material is different from said second material,
- a power source comprising a battery holder,
- means for activating said power source operatively associated with said case.

In another aspect the present invention relates to a portable torch as described above wherein at least one lens is inserted in the light path from the light emitting diodes, namely a portable torch comprising

- a case having a first and a second open ends, a first cap covering the first open end and a second cap covering the second open end, said first cap having a transparent area,
- illumination means having a diode area comprising a plurality of light emitting devices (LEDs) arranged to emit light out of the first open end and through the transparent area of the first cap,
- at least one lens arranged in the light path from a light emitting device,
- a heat sink arranged to transport heat from the light emitting devices,
- a power source comprising a battery holder
- means for activating said power source operatively associated with said case.

In a third aspect the present invention relates to a waterproof portable torch comprising

- a case having a first and a second open ends, a first cap sealingly covering the first open end and a second cap sealingly covering the second open end, said first cap having a transparent area,
- illumination means having a diode area comprising a plurality of light emitting devices (LEDs) arranged to emit light out of the first open end and through the transparent area of the first cap,
- a heat sink arranged to transport heat from the light emitting devices,
- a power source comprising a battery holder
- means for activating said power source operatively associated with said case, said means comprising at least two switch buttons sealingly arranged on the case.

In a fourth aspect the present invention relates to a portable torch having at least three light emitting diodes, namely a portable torch comprising

- a case having a first and a second open ends, a first cap covering the first open end and a second cap covering the second open end, said first cap having a transparent area,
- illumination means having a diode area comprising a plurality of light emitting devices (LEDs) arranged to emit light out of the first open end and through the transparent area of the first cap, said plurality of light emitting devices being arranged with at least three diodes,
- a heat sink arranged to transport heat from the light emitting devices,
- a power source comprising a battery holder
- means for activating said power source operatively associated with said case.

In a fifth aspect the present invention relates to a portable torch that also functions as a power source tank for a second battery-driven device, namely a portable torch and power source tank comprising

- a case having a first and a second open ends, a first cap covering the first open end and a second cap covering the second open end, said first cap having a transparent area,
- illumination means comprising a light source arranged to emit light out of the first open end and through the transparent area of the first cap,
- means for connecting a battery-driven device,
- a power source comprising a battery holder,
- means for activating said power source operatively associated with said case, whereby said means are capable of activating the illuminating means independently of activating the battery-driven device connected to said case.

In a sixth aspect, the present invention relates to a torch having a magnet for attachment to a surface. Accordingly, the invention relates to a portable torch comprising

- a case having a first and a second open ends, a first cap covering the first open end and a second cap covering the second open end, said first cap having a transparent area,
- illumination means comprising a light source arranged to emit light out of the first open end and through the transparent area of the first cap,
- a power source comprising a battery holder,
- means for activating said power source operatively associated with said case, whereby at least one magnet is arranged in said case at a position so that the means for activating the power source are activated when the torch is attached to a surface through the at least one magnet.

In a seventh aspect, the invention relates to a torch comprising a case having a first and a second open ends, a first cap covering the first open end and a second cap covering the second open end, said first cap having a transparent area, illumination means comprising a light source arranged to emit light out of the first open end and through the transparent area of the first cap, a power source comprising a battery holder, means for activating said power source operatively associated with said case, wherein the means for activating the power source also functions as a pressure valve.

The present invention further relates to a modular kit comprising a portable torch, as defined above, and at least one second battery-driven device, wherein said second battery-driven device is capable of being connected to the portable torch for sharing battery with the portable torch or wherein a cap comprising a diode area of the second battery-driven device is capable of being connected to the portable torch.

In yet another aspect the invention relates to a battery-driven device, said battery-driven device being adapted for connecting a portable torch as defined above for sharing battery with the portable torch or wherein a cap comprising a diode area of the second battery-driven device is capable of being connected to the portable torch.

DESCRIPTION OF THE DRAWINGS

FIG. 14*a* shows the switch arrangement of the portable torch, FIG. 14*b* shows a switch in greater detail, FIG. 14*c* shows the switch during valve ventilation, and FIG. 14*d* shows the switch arrangement adjacent to a magnet.

DETAILED DESCRIPTION OF THE INVENTION

Figure 1A:
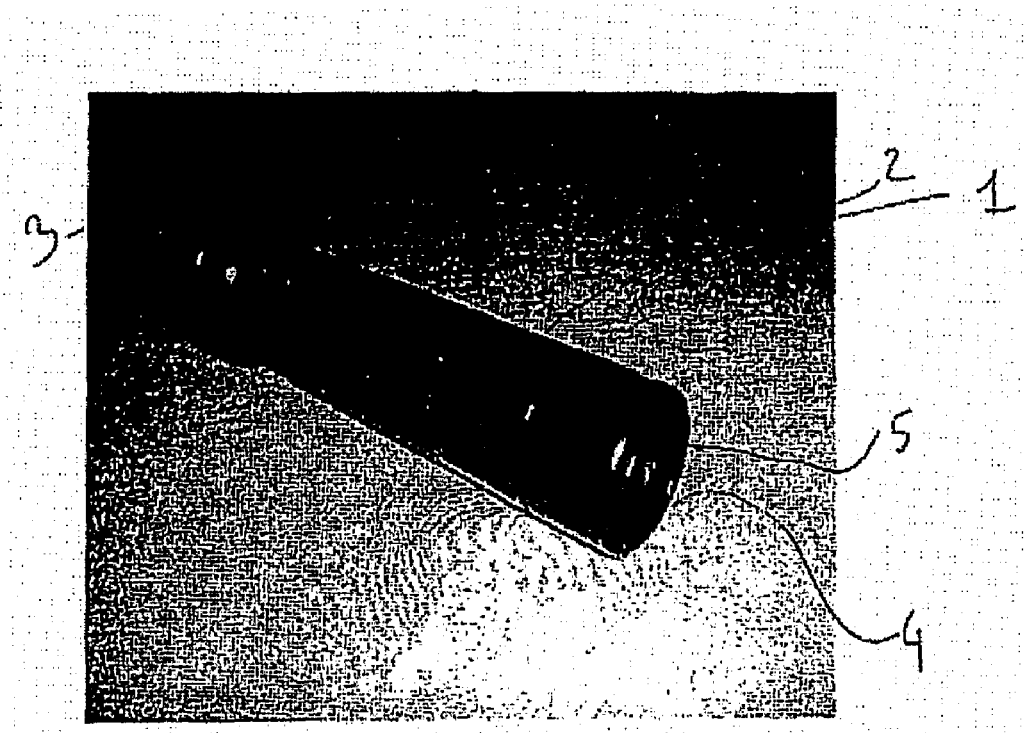
FIGS. 1*a*, 1*b* and 1*c* show a portable torch according to the invention.

The present invention relates to a portable torch or hand-held portable illumination having several features and capable of having several functions that is to be explained in the following.

The portable torch according to the present invention may have at least one of the following features and/or functions:

Powerful light effect

Waterproof case

Flashing effect

Tail-light

Function as battery tank

Programmable light functions

The features and functions are described in more detail in the following. In the pre-sent context upwards or upper means towards the first end of the portable torch, whereas downwards or lower means towards the second end of the portable torch.

Light Effect

One important aspect of the present invention is a portable torch providing a powerful light effect, such as effect of at least 100 lumen, more preferably at least 200 lumen, more preferably at least 300 lumen, more preferably at least 400 lumen, more preferably at least 500 lumen, more preferably at least 600 lumen, more preferably at least 700 lumen, more preferably at least 800 lumen.

The powerful effect is obtained because the present invention takes advantage of light emitting diodes (LEDs) in the visible spectrum and/or in the infra-red (IR) spectrum and/or in the ultra-violet (UV) spectrum arranged in a configuration providing the light effect effectively.

A light emitting diode (LED) is a compact semiconductor device that generates light of various colors when a current is passed through it. The color depends primarily upon the chemical composition of the light emitting components of the LED die. LEDs exhibit various advantages over incandescent, fluorescent, and discharge light sources, including smaller size, longer life, lower power requirements, good initial drive characteristics, high resistance to vibration and high tolerance to repeated power switching. Because of these favorable characteristics LEDs are widely used in such applications as indicators and low-power lighting applications.

Although LEDs are more efficient than prior art light sources, they are not 100% efficient in converting electrical energy to light. As a result, a great deal of heat can be produced by the LED die. If the heat is not adequately dissipated, mechanical stress is imposed on various internal components of the LED due to the differing coefficients of thermal expansion of the internal components. This stress can lead to failure of the LED. Therefore, heat sinks are often employed to dissipate heat generated by the LED. The heat sink is usually provided through the metal leadframe of the LED.

The amount of heat generated by the LED becomes an even greater concern as higher-power LEDs are developed for high-brightness applications. The heat accumulation has previously been a limiting factor for increasing the number of LEDs in a portable illumination means, because LEDs has to be arranged sufficiently far from each other to secure that the heat produced by one LED does not disturb the function of a neighbour LED, which is especially true if an LED is surrounded by other LEDs. On the other hand the size of a portable torch cannot increase beyond a certain limit, otherwise the portability of the torch is lost.

The present invention however offers a possibility of increasing the number of LEDs without tampering the function of individual LEDs, such as reducing the life time of the LEDs, and at the same time provides a compact portable torch. This is due to the fact that the portable torch according to the invention comprises a heat sink arranged to transport heat from the LEDs. Thereby LEDs may be arranged closer to each other than what is the case if no heat sink is present, and accordingly, more LEDs may be arranged in the portable torch leading to a higher light effect.

The LEDs are preferably designed to be assembled onto a printed circuit board and secured using soldering process. In the present context the term "diode area" includes the printed circuit as well as the space between the diodes. In the present invention a plurality of LEDs are preferably mounted on the printed circuit by a solder connection to the legs of the LEDs in the usual manner in the art. Thereby the LEDs extend from the lower surface of the printed circuit.

In one embodiment it is preferred that the portable torch comprises at least 3 LEDs, more preferably the portable torch comprises at least 5 LEDs, such as at least 7 LEDs. The LEDs may be arranged in any suitable pattern in the portable torch. When the torch comprises more than three LEDs, it is however preferred that the LEDs are arranged with at least one central LED surrounded by a number of LEDs.

Independent of the pattern it is preferred that the heat sink is arranged to remove heat from the central part of the LED area. In particular if the LEDs are arranged in a circular pattern it is preferred to remove heat from the central part of the LED area.

The LEDs may be any suitable types of LEDs, such as LEDs of various shapes, colors, and/or viewing angles. In some embodiments, white LEDs are used (such as white LEDs that utilize a blue LED chip and a YAG phosphor that converts a portion of the blue light to yellow, thus yielding a white-appearing light output. In other embodiments, standard high-efficiency colored LEDs of red, yellow, green, and/or blue are used to provide light of the desired intensity and color. In one such embodiment, LEDs of each color are preferably controlled separately in order to provide the desired overall hue or whiteness of the combined light output.

Other embodiment include IR LEDs for military or police use to enhance the usefulness of night-vision equipment and for friend-or-foe identification. Other specialized uses may be long-wavelength LEDs, 660 nm or longer to provide underwater divers a light source for observing undersea life at night without adversely affecting the nocturnal activities of such wildlife.

In order to provide the powerful light effect desired by the present invention the effect of each LED is preferably at least 2 W, more preferably at least 3 W, more preferably at least 4 W, more preferably at least 5 W, more preferably at least 6 W.

In a preferred embodiment the LEDs are selected from LEDs from Luxeon Emitter or Osram Ostar. Each LED preferably provides at least 30 lumen, more preferably at least 40 lumen.

In a preferred embodiment the portable torch provides at least 5 LEDs within a diameter of 54 mm, such as at least 7 LEDs within a diameter of 54 mm. In another embodiment the portable torch is provided with at least 2 LEDs within a diameter of 40 mm, such as at least 3 LEDs within a diameter of 40 mm. Thereby the distance between the center of one LED to the center of a neighbouring LED is at most 2.1 cm, such as at most 1.8 cm.

Lenses

A preferred feature of some of the aspects of the present invention is to provide a large number of LEDs per square unit in order to provide a sufficient generalized and/or focused illumination. Therefore, a refinement of the invention utilizes a lens or a reflector arrangement to provide a focusable light source. Thus, in one embodiment of the invention the portable torch light is provided with means for controlling the "viewing" angle of the LEDs in order to achieve wide-angle viewing versus narrow-angle, long-range viewing and combinations thereof.

An example thereof is a portable torch wherein a lens is provided in the light path of at least one LED, preferably wherein a lens is provided in the light path of all LEDs. Thereby the viewing angle may be controlled. The lens may be one lens generalizing or focusing the light from all LEDs or in a more preferred embodiment a lens is arranged for each LED. The lens(es) is(are) preferably integrated with the transparent area of the first cap. In a preferred embodiment hereof the lenses are arranged in recessed parts of the transparent area, as explained for example in relation to FIG. 2, whereby the risk of damaging the lenses, such as damaging by scratching is reduced.

The lenses may be of any suitable type, such as Fresnel lenses or mirror coated lenses, such as coated with metal or metal alloys.

Examples of preferred configurations of viewing angles are the following

- A portable torch wherein the optical axis of a first LED and the optical axis of a second LED are parallel. Thereby neither convergence nor divergence of light from two or more LEDs occur.
- A portable torch, wherein lenses are arranged so that light from at least two LEDs converge, such as to provide a central focused light path.
- A portable torch, wherein lenses are arranged so that light from at least two LEDs diverge, such as to provide a defocused light.

Heat Sink

As described above the present invention provides a portable torch capable of arranging a large amount of LEDs on a small area without impairing the function of the LEDs. This is due to a heat sink arranged to remove heat from the LEDs, in particular from a central LED.

Thus, in the present context the term "heat sink" or "heat dissipating means" refer to means for transporting heat away from the diodes, in particular from a central diode, so that the temperature around the diodes does not exceed a level above which the function and lifetime of the diodes are unacceptably reduced.

In a preferred embodiment the heat sink comprises a core of heat sink material, such as metal, such as selected from the group of material consisting of Aluminium, Copper, Silver, Platinum, and Gold. The heat sink may be constructed in any suitable way taking into account that the heat sink should have as large a surface area as possible on one hand, and on the other hand should still be of a handy size. In one embodiment the heat sink is provided with a plurality of axially extending ribs to increase the surface area. By the term "axially" is meant parallel with an axis extending from the first end to the second end of the torch.

The heat sink may be in one part or may be constructed of several parts, such as being constructed of at least two parts. When the heat sink is constructed of more than one part the individual parts are connected by means of thermally conducting material.

In one embodiment the heat sink comprises a central part of a first material and at least one peripheral part of a second material. It is preferred that the first material has a higher heat conductivity than the second material whereby the heat is transferred rapidly from the diode area. Heat conductivity is used in its conventional meaning, i.e. the quantity of heat transmitted through a unit thickness. Heat conductivity may also be denoted heat transfer coefficients.

The second material may preferably have a higher heat capacity than the first material so that the second material is capable of "storing" more energy before the temperature of the second material is raised. Heat capacity is used in it's conventional meaning, i.e. the measure of the quantity of energy needed to raise the temperature of a unit quantity of the material through 1 degree of temperature.

In a preferred embodiment the first material is selected from copper, gold or silver or a metal or an alloy having a heat capacity and/or a heat conductivity as one of those metals. The second material is preferably selected from aluminium or a metal or alloy having a heat capacity and/or a heat conductivity as aluminium. Preferably, the peripheral part is arranged with a plurality of radially extending parts as described above.

The height of the heat sink, wherein height is the dimension in the axial direction, is preferably at least 1.0 cm, more preferably at least 1.5 cm, more preferably at least 2.0 cm, in order to provide a sufficient surface area. Furthermore, it is preferred that the width of the heat sink corresponds to the width of the inner case so that the heat sink with ribs extends to the inner case wall.

The heat sink is preferably constructed so that is provides a bearing surface for each LED. Examples of configurations of the heat sinks are shown in FIG. 13.

In a preferred embodiment the heat sink is thermally connected to a rod extending from the printed circuit, and thereby the diode area, and at least to the heat sink. The rod is preferably arranged axially, and more preferably centrally in the torch. Thereby the rod may also function to fix the printed circuit in relation to the inner torch assembly. The rod extends from the diode(s) and through the part of the case housing the battery(ies), whereby the heat is transported away from the diode area and also distributed in the case. The rod is preferably arranged as the central part as described above, and consequently the rod is preferably made from copper, or a metal or an alloy having a heat capacity and/or a heat conductivity as copper, such as gold or silver.

In order to save space in the case, the heat sink rod may constitute at least a part of the battery holder, such as the embodiment wherein the battery holder comprises at least two pins connected to a central pin, said central pin being the heat sink rod.

In one embodiment the heatsink system is based on a copper rod connecting one or more aluminium heat sinks, and the torch comprises 7 LEDs as described above. The copper rod has a large heat capacity (cp) per volume and also a good heat transfer to the outer area. This system can absorb the heat at maximum power for some minutes. As described in more detail below, the driver and controlling circuit include a temperature sensor, so when maximum allowed temperature is reached a dimming function will reduce the current in the LED's.

In the following an example of heat transfer calculations is described for a heat sink comprising a central copper rod connected to aluminium heat sinks. In the example the following approximations have been done the cooling elements are regarded as one element power transfer to the battery back is disregarded heat convection to ambient is disregarded Under these conditions maximum temperature rise for a given time can be calculated:

Heat capacity=Specific heat*Weight

Copper specific heat=385J/(kg*° C.)

Aluminum specific heat=896J/(kg*° C.)

Copper Weight=0.022kg

Aluminum Weight=0.111kg

Whereby the Heat Capacity for the system is =896*0.111+385*0.022=108J/° C.

Maximum dissipated heat from LED system=1.4A*7*3.5V*0.9=31W

And Temperature rise per second=31/108=0.28° C./s

Since no heat dissipation to ambient is deducted then this is maximum temperature rise. In a preferred embodiment the torch electronic will measure temperature and decrease current when temperature exceeds 55° C. Given time constants in the system this equates a heat sink temperature of approximately 60 to 65° C. For each 20 seconds, the current level will then be decreased one step as long as temperature is measured above 55° C. The torch has preferably several light levels defined, such as preferably at least 10 light levels, more preferred at least 15 light levels, such as 18-20 light levels.

Now given an ambient temperature of 20° C. and the fact that dissipated power will start decreasing at 60° C. it will take a minimum 40/0.28=142 seconds before light level will start decreasing.

Case

The portable torch according to the invention comprises a case, said case having any convenient size and shape, and is typically designed to hold the battery, provide a suitable grip to be handheld, and provide a housing for the inner torch assembly, such as battery, circuitry, heat sink and LEDs. The case has a first open end and a second open end through which the torch may be mounted during assembling. The case is preferably provided with a first cap covering the first end and a second cap covering the second end. Said first cap has a transparent area through which the light from the diodes pass. Said first cap preferably comprises in said transparent area the lenses discussed above. The first cap may be attached to the case through any suitable means, such as releasably attached for example through threads, lock rings or splits.

The second cap may be provided with means for connecting another battery-driven device. Thereby the torch may be capable of functioning as a battery-tank for another battery-driven device. Furthermore, the second cap may comprise means for connecting the portable torch to a recharging unit for recharging the batteries.

In a preferred embodiment the portable torch is waterproof and/or gas-proof, whereby the connections from case to caps are sealed, for example by means of O-rings suitably arranged. Likewise are any other penetrations of the case, such as switches, sealed, for example by means of O-rings or the like.

The case may be made from any suitable material, such as machined from a metal, such as a metal selected from Aluminium and Titanium. The case may be black or titanium anodized to obtain a finish, and/or the case may be coated at least partly with a suitable material to improve the grip of the torch, such as an elastomeric material.

Battery and Portable Power Source

The power source of the portable torch of the present invention is preferably rechargeable batteries housed in the case. The batteries serve to provide power to the diodes emitting light through the transparent area of the first cap. In addition thereto the batteries may provide energy to another battery-driven device, such as another light connected to the second cap. Thereby the portable torch serves as portable power source for a second battery-driven device. Furthermore, the battery (batteries) may drive any computer arranged to control the torch function.

Any suitable rechargeable battery may used, such as a battery pack available from a line or series of battery packs having different predetermined operating voltages that fall within the range from 1.2V to 24.0V DC. Apart from the difference in operating voltage, all battery packs of the same line have substantially the same physical shape and size, at least insofar as their stems (for internal connection) and the upper peripheries of their bodies (for external matching) are concerned, such that any one of the battery packs can fit the torch light.

In a preferred embodiment, wherein the portable torch also serves as a portable power source as described above, it is preferred that the battery can supply at least 12 volt 2 Amp, i.e. 24 VA, more preferably about 12 Volt 4 Amp, i.e. 48 VA, wherein VA means Volt Ampere.

The portable torch may be provided with an alarm function when the battery level is low. Such an alarm function may be a sound or a stroboscopic light effect.

The battery is preferably recharged while remaining in its position in the case. In a preferred embodiment the battery is recharged through a connection in the second cap. In a more preferred embodiment the connection for connecting a second battery-driven device is identical with the connection for connecting to a recharging unit.

Preferably, the battery pack is to be inserted downwards into the case of the torch as part of the inner torch assembly, for locating thereby. In doing so, the battery stem preferably extends to the inner case wall.

Switches and Circuitry

The inner torch assembly is in a preferred embodiment arranged to contain a rechargeable battery, and at least one light emitting means in the form of an LED, connected to at least one switch. Furthermore, that battery is connected to an electrical input terminal for supplying electrical power to the rechargeable battery. The battery, the LED(s) and the electrical input terminal are electrically coupled via a circuit mounted on a printed circuit board.

The application of the electrical energy to the LEDs is controlled by means of a switch arrangement, which is attached to the case at any suitable place, such as on the side of the torch or in the second cap. Any appropriate technique may be used for securing the switch arrangement to the case. A preferred arrangement is shown in FIG. 14. The switch arrangement may include a number of switches for controlling various functions of the portable torch, it is however preferred that the portable torch comprises only switches in order to simplify the use of the portable torch. The switches are normally programmed to perform a variety of parameters thereby allowing the user to control various flashlight functions such as, for example, on/off, setting light level, setting light color, setting pulse or strobe frequency, and checking battery voltage or remaining power. For example one switch may turn on light, and the other turn off light. Increasing/decreasing the light output may be done by keeping one switch down until the desired light output is reached. The portable torch could furthermore be programmed so that activation of one or both switches in preprogrammed steps could provide stroboscopic light effect or any other relevant light effect, such as an SOS-signal. Furthermore, the switch arrangement is preferably also programmed to activate any second battery-driven device coupled to the second end of the portable torch. In a preferred embodiment it is possible to control the illumination of the torch and the second battery-driven device independently.

In another embodiment only one switch is provided for on/off as well as for other programs whereby the frequency of activation of the switch may activate different functions.

In one embodiment the switch arrangement is programmed to receive a feedback signal from a feedback circuit, and on the basis of the feedback signal adjust for example the light output to prevent overloading and premature destruction of LEDs while minimizing power dissipation, thus maximizing battery life, providing the desired accuracy or level of the amount of light emitted at different battery voltages or other environmental conditions that would otherwise vary the light output. In particular the feedback signal could be triggered if the temperature in the diode area exceeds an acceptable level. In such an embodiment it is preferred that a temperature measurement means is arranged for example on the printed circuit board.

Furthermore, in a preferred embodiment the switch arrangement is programmed to provide a relatively constant light output level even as battery voltage declines and power is drained.

The portable torch may be preprogrammed with functions and/or the programs of the portable torch may be customised.

It is preferred that a programmable microprocessor is utilized to provide control functionality of the switches. However, a variance of this embodiment uses a thumbwheel, or rotary switch to vary the switching characteristics to produce a variable light output.

A magnet may be arranged adjacent to the switch arrangement for attachment. When the torch is attached to a surface, the switches are preferably activated due to pressure from the surface. The constant pressure from the surface may lead to a special illumination, for example a stroboscopic light for use in case of accidents.

The switches may also function as pressure valves to reduce pressure in the torch body. An example hereof is shown in FIG. 14.

Second Battery-Driven Device

In a preferred embodiment second cap of the case of the portable torch according to the invention has means for connecting a second battery-driven device to the battery of the portable torch. In a preferred embodiment, the means is arranged in the second cap. The second battery-driven device may be any kind of battery-driven device often used in connection with a portable torch. Accordingly, the second battery-driven device may be a light directly attached to the second end portable torch, or alternatively the second battery-driven device is connected through a line to the second end of the portable torch, whereby the second light may be born separate from the first light, for example in the cap of the user. In yet another embodiment a cap comprising a diode area of the second battery-driven device is connectable to the portable torch.

The second light may also serve other purposes than the first light. For example the second light may be infrared or ultraviolet, whereas the first light is white light, or the second light may be a flashing light. In another embodiment the second light may be coloured for friend-or-foe identification. Other examples of the second battery-driven device are a laser, a radio, a mobile telephone, sensors, recording equipment, such as audio or video equipment.

In one embodiment the second battery-driven device is a second torch or light, also called a taillight. The illumination means of the taillight is preferably an LED, such as the LEDs described above. In a preferred embodiment the LED of the taillight is an LED provided by OSRAM Ostar), such as an LED providing at least 200 lumen per diode. In a more preferred embodiment the tail-light is provided with a heat sink independent from the heat sink of the first illumination means.

In another embodiment the second battery-driven device is a second torch or light carried independent from the portable torch, only being connected to the portable torch during recharging of the second torch. The illumination means of the taillight is preferably at least one LED, such as the LEDs described above. In a preferred embodiment the LED of the second torch is an LED provided by OSRAM Ostar), such as an LED providing at least 200 lumen per diode. In a more preferred embodiment the second torch is provided with a heat sink independent from the heat sink of the portable torch. In a preferred embodiment the second torch comprises a case having any convenient size and shape, and is typically designed to hold the battery, provide a suitable grip to be handheld, and provide a housing for the inner torch assembly, such as battery, circuitry, heat sink and LEDs, wherein the case has a first open end and a closed second end, so that the torch may be mounted during assembling through said first open end. The case is preferably provided with a cap covering the first end, wherein said cap has a transparent area through which the light from the diodes pass. Said cap may comprise in said transparent area the lenses discussed above. The cap may be releasably attached to the case through any suitable means, such as releasably attached for example through threads, lock rings or splits. The open end is provided with means for connecting the portable torch for recharging the batteries of the second torch, so that when recharging is necessary, then the cap is removed from the second torch, and the second torch is connected to the second end of the portable torch for recharging the second torch.

As described in relation to the portable torch, any second battery-driven device may be water-proof and/or gas-proof, whereby the connections from case to caps are sealed, for example by means of O-rings suitably arranged. Likewise are any other penetrations of the case, such as switches, sealed, for example by means of O-rings or the like.

The case of any second battery-driven device may be made from any suitable material, such as machined from a metal, such as a metal selected from Aluminium and Titanium. The case may be black or titanium anodized to obtain a finish, and/or the case may be coated at least partly with a suitable material to improve the grip of the torch, such as an elastomeric material.

Switches for said second battery-driven device may be arranged at any suitable position of the torch, it is however preferred when the second battery-driven device has a closed end opposite the diode(s) that the switch(es) is(are) arranged in the closed end.

Furthermore, a magnet may be positioned on or in the case of a second battery-driven device, such as positioned in the closed end.

Modular Kit

In one aspect the present invention relates to a modular kit comprising two or more modules, wherein a portable torch as defined herein is one module and another module(s) is one or more second battery-driven devices, wherein the each of said second battery-driven devices and/or a cap comprising a diode area of said second battery-driven device are connectable to the portable torch as described above.

DETAILED DESCRIPTION OF THE DRAWINGS

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

Figure 1B:
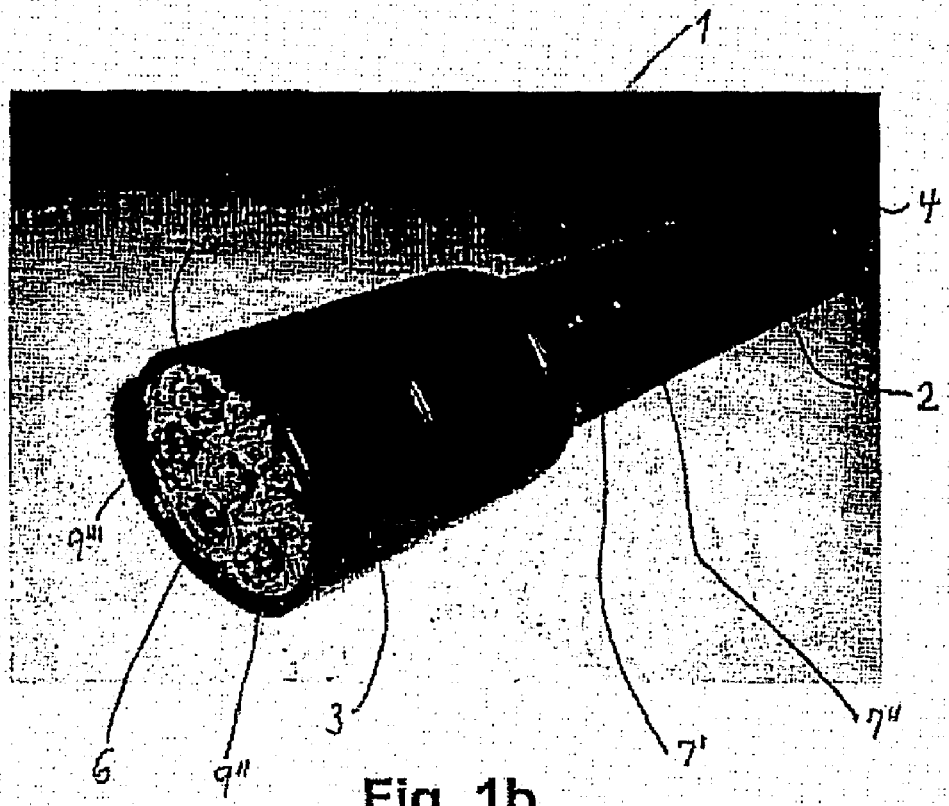
Figure 1C:
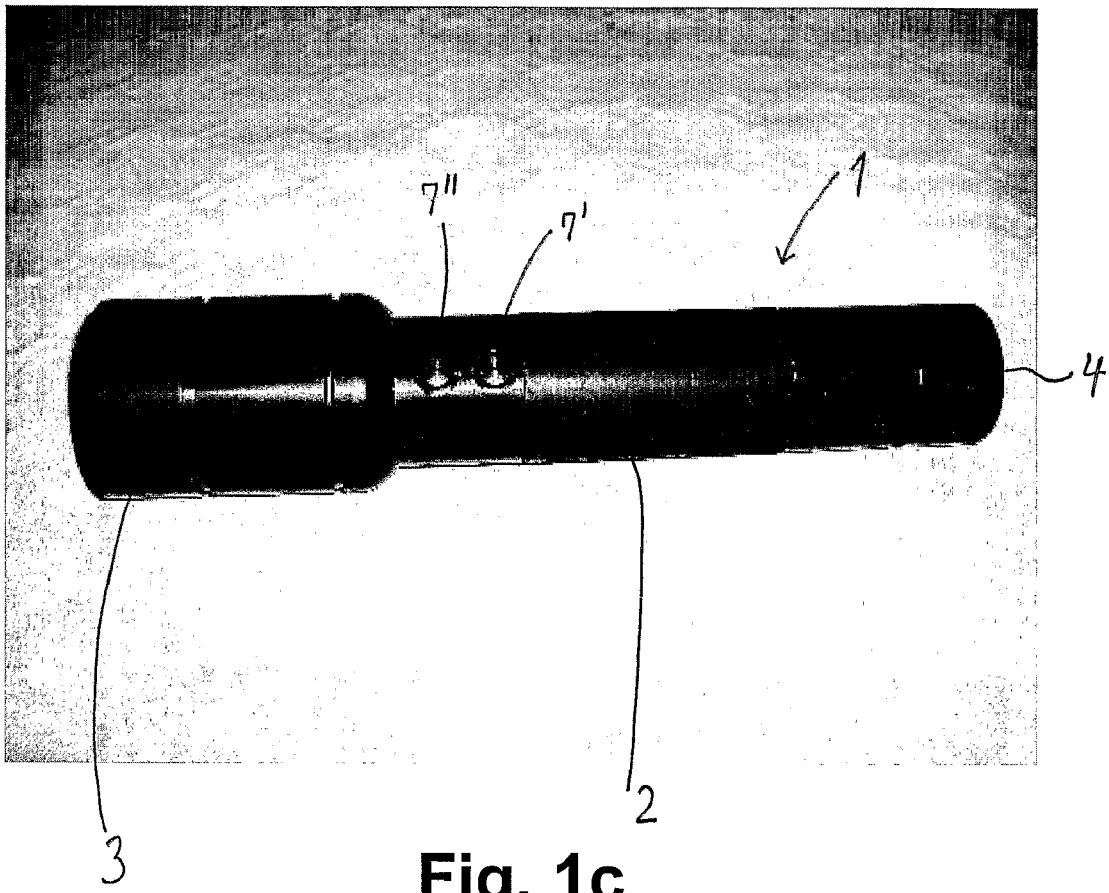

FIG. 1*a* shows the portable torch 1 according to the invention seen from the second end of the torch. The torch 1 has a case 2 and a first end being closed with a first cap 3 and a second end being closed with a second cap 4. The second cap 4 is provided with connection means 5 for connecting a second battery-driven device to the portable torch 1, whereby the portable torch 1 serves as a battery-tank for the second battery-driven device. FIG. 1*b* shows the portable torch 1 seen from the first end of the torch. Thereby the transparent area 6 of the first cap 3 is shown. The transparent area 6 comprises seven recesses corresponding to seven diodes. In each recess a lens is located (not shown). The portable torch 1 further provides two switches 7', 7" for controlling the function of the portable torch 1. In FIG. 1*c* the portable torch 1 is seen from the side showing the first cap 3, the second cap 4 as well as the switches 7', 7".

Figure 2A:
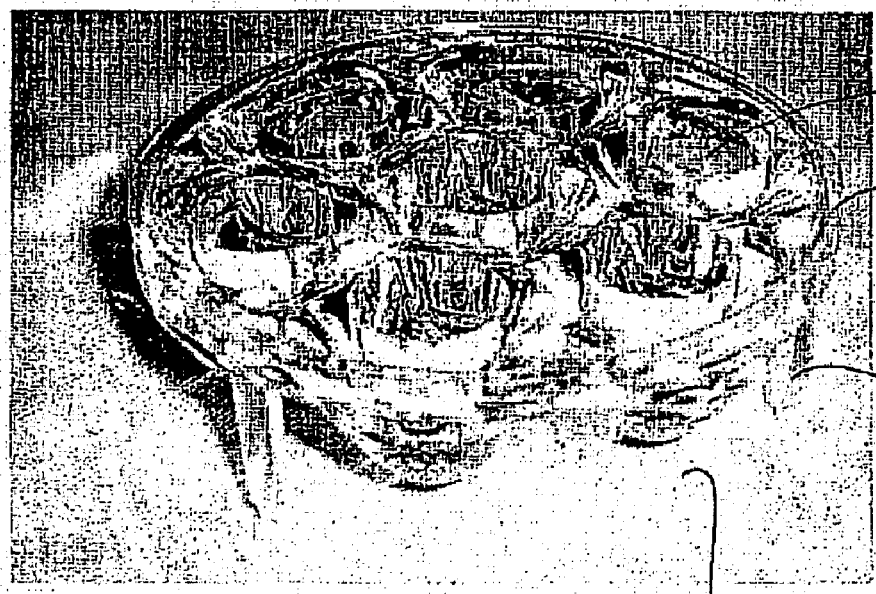
FIGS. 2*a* and 2*b* show the transparent area of the first cap of the portable torch with recesses comprising lenses.
Figure 2B:
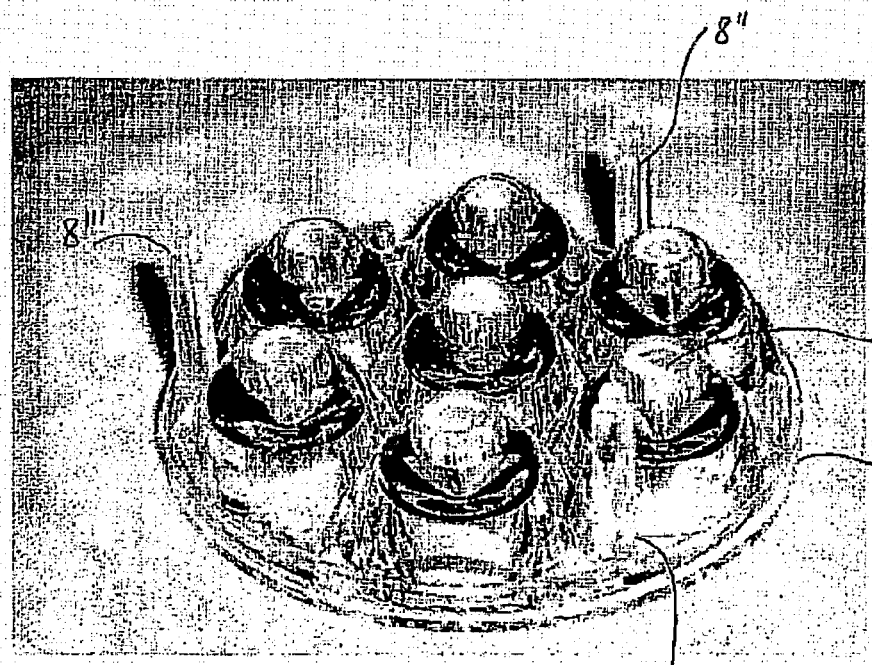

FIG. 2*a* shows the outer surface of transparent area 6 of the first cap. The transparent area 6 is provided with seven recesses 9, a recess 9 for each diode of the portable torch. In the bottom of the recess 9 a lens 10 is provided. By arranging the lens 10 in a bottom of a recess 9, the risk for scratches on the lens 10 is minimized. The transparent area 6 is positioned to a diode area (not shown) below the transparent area 6 by means of fastening rods 8. FIG. 2*b* shows the inner surface of the transparent area 6 of FIG. 2*a*. The lens 10 is shown positioned in the bottom of the recesses. Three fastening rods 8 are provided for positioning the transparent area 6.

Figure 3:
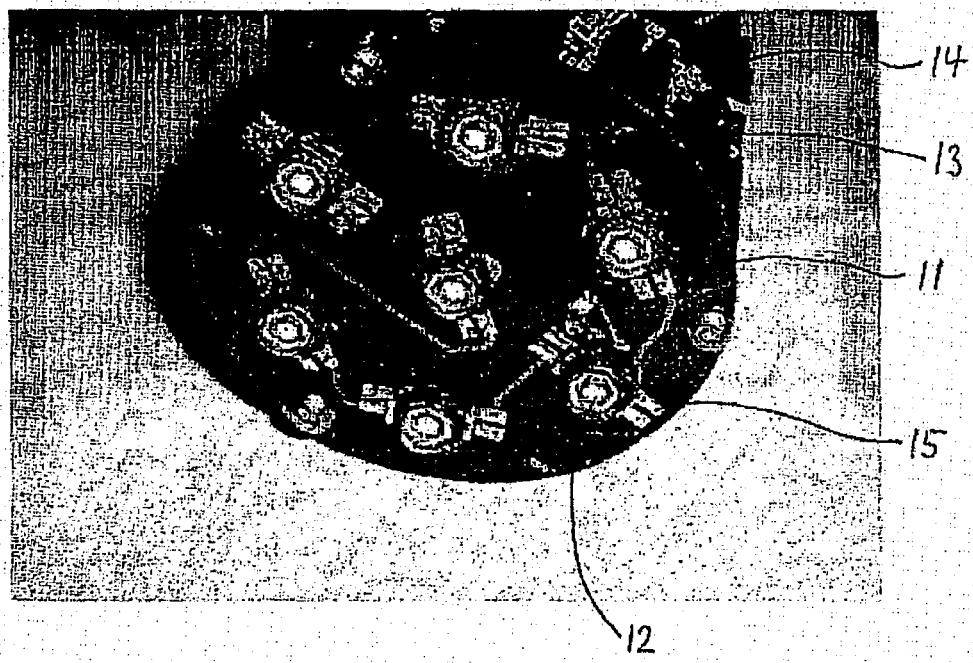
FIG. 3 shows the diode area of the portable torch.

FIG. 3 shows a diode area 11 having seven diode positions 12 for positioning diodes. Diodes are provided with power from the power source through circuit 13. A heat sink 14 is positioned below the diode area 11.

Figure 4:
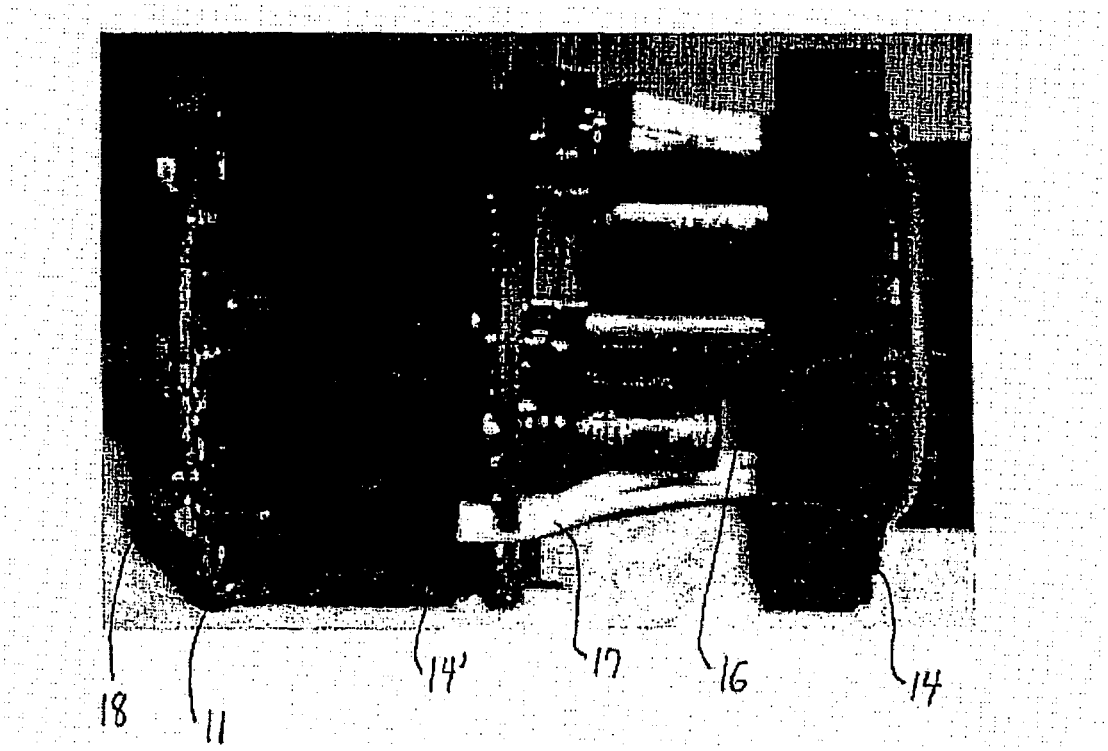
FIG. 4 shows the heat sink of the portable torch according to the invention.

FIG. 4 shows the heat sink 14 of the portable torch in greater detail. The heat sink is constituted of two parts, 14' and 14". The heat sink part 14' is located immediately below the diode area 11. The heat sink 14' is provided with multiple heat sink ribs for increasing the surface area of the heat sink 14'. By increasing the surface area of the heat sink 14, the heat sink capacity for transporting heat from the diode area is increased. The heat sink part 14" is located below the heat sink part 14' leaving a distance between the two heat sink parts, 14' and 14". Heat sink 14" is also provided with ribs. The two heat sink parts 14' and 14" are connected thermally through central rod 16. Heat sink 4 as well as the central rod 16 are made from a thermally conducting material. The central rod 16 is extending from the central diode position of the diode area 11 above the heat sink 14', whereby the central rod 16 is capable of directing heat produced by the diodes 18 away from the diode area 11 and into the heat sink parts 14' and 14". Apart from functioning as heat sinks the two heat sink parts, 14' and 14", may also serve as anchor means for other elements in the portable torch. For example the heat sink part 14" may serve as anchor means for the battery holder thereby the inner torch assembly may be connected as one unit.

A cross section of the heat sink is shown in FIG. 13.

Figure 5:
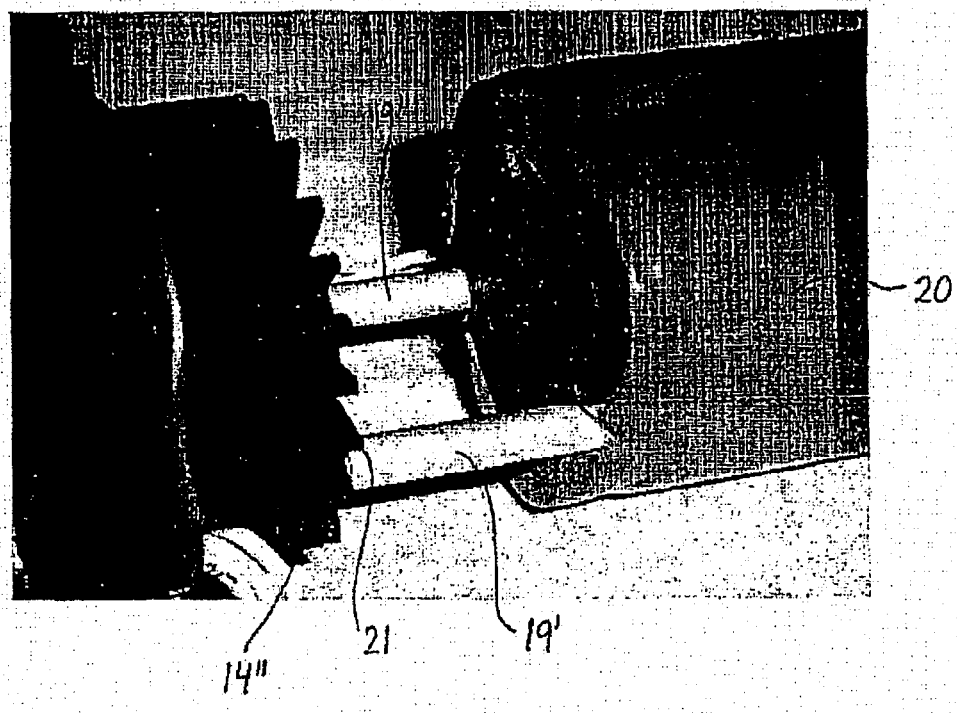
FIG. 5 shows the heat sink connected to the power source.

In FIG. 5 the lower heat sink part 14" is shown. Extending from the heat sink part 14" are two battery holder rods 19' and 19". The battery holder rods 19' and 19" hold and position the battery unit 20 in a fixed relationship with the remaining elements of the torch, whereby the inner torch assembly may be seen as one unit.

Figure 6:
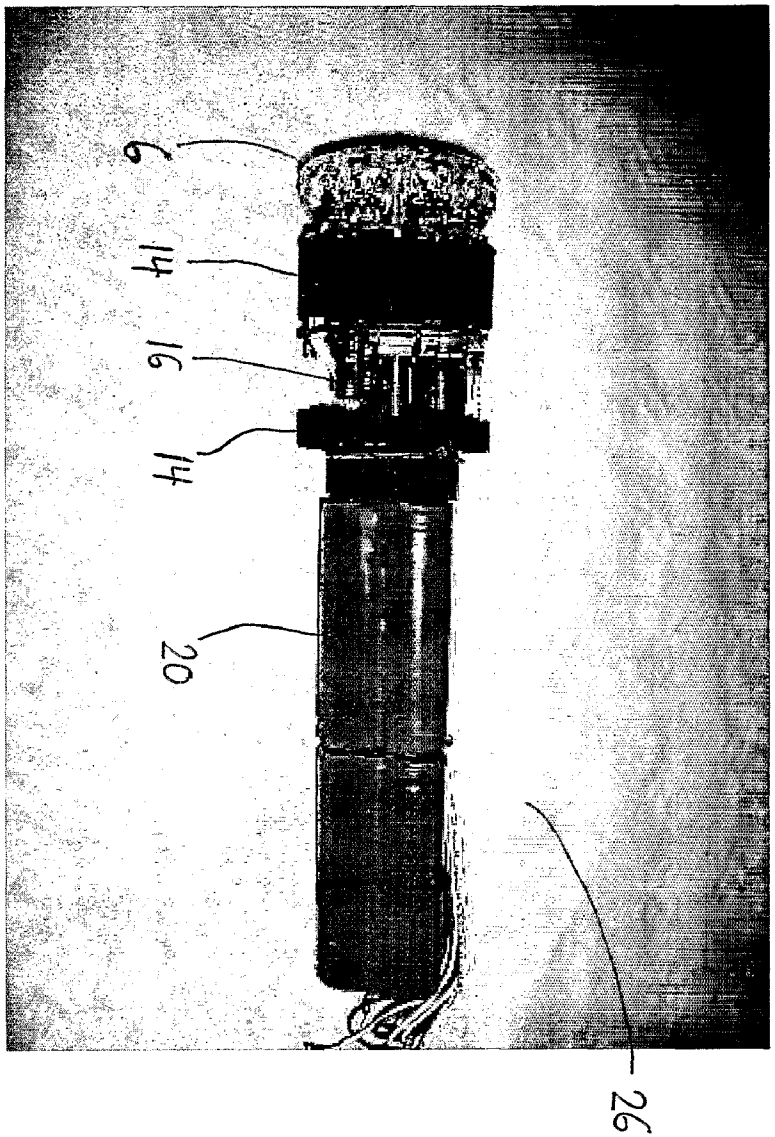
FIG. 6 shows the inner torch assembly.

FIG. 6 shows the inner torch assembly 26 with the transparent area 6 of the first cap as one unit. The inner torch assembly 26 consists of diodes 18 positioned on the diode area 11. Below the diode area 11 are the two heat sink parts 14' and 14" spaced apart from each other. The two heat sink parts, 14' and 14", are connected through central rod 16. The battery unit 20 is attached through battery holder to the heat sink part 14". During assembling the inner torch assembly is inserted into the case of the portable torch through the first end of the portable torch. Once the inner torch assembly is in place the first cap and the second cap may be attached thereby closing the portable torch.

Figure 7A:
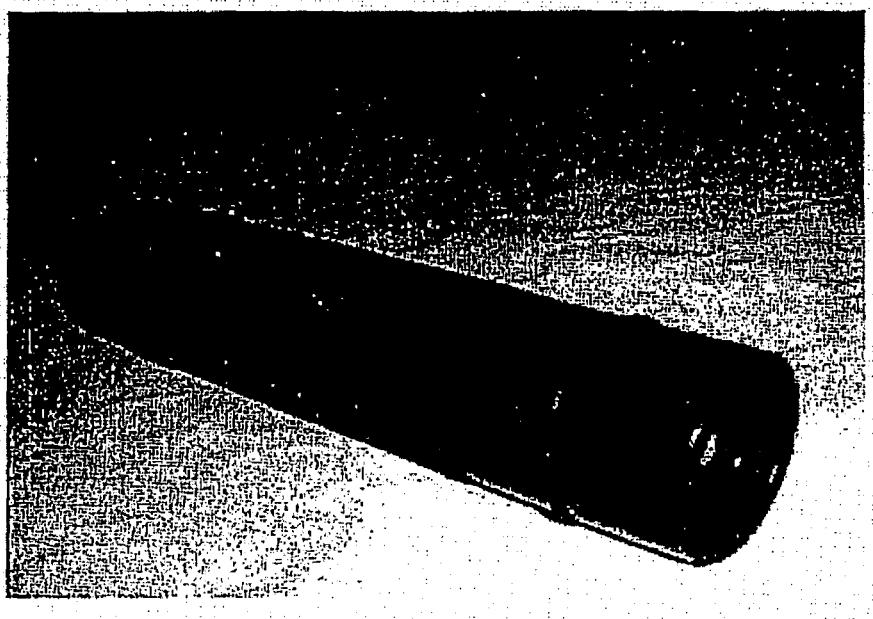
FIGS. 7*a*, 7*b* and 7*c* show an alternative portable torch according to the invention.
Figure 7B:
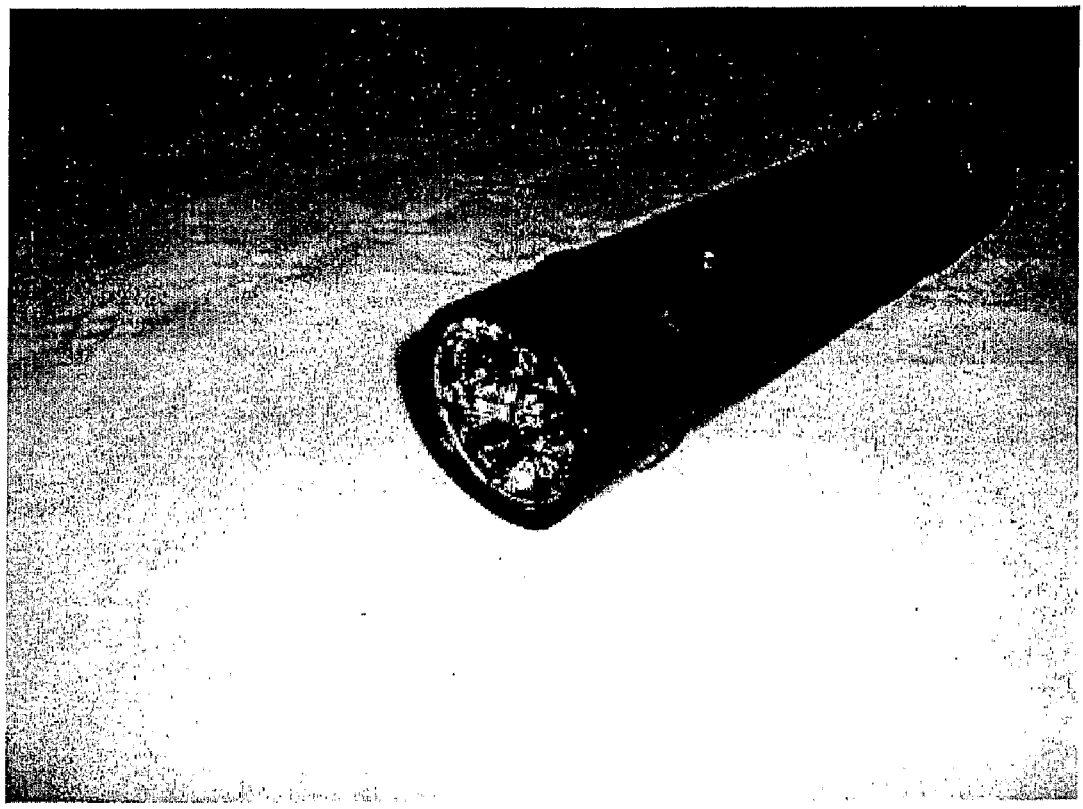
Figure 7C:
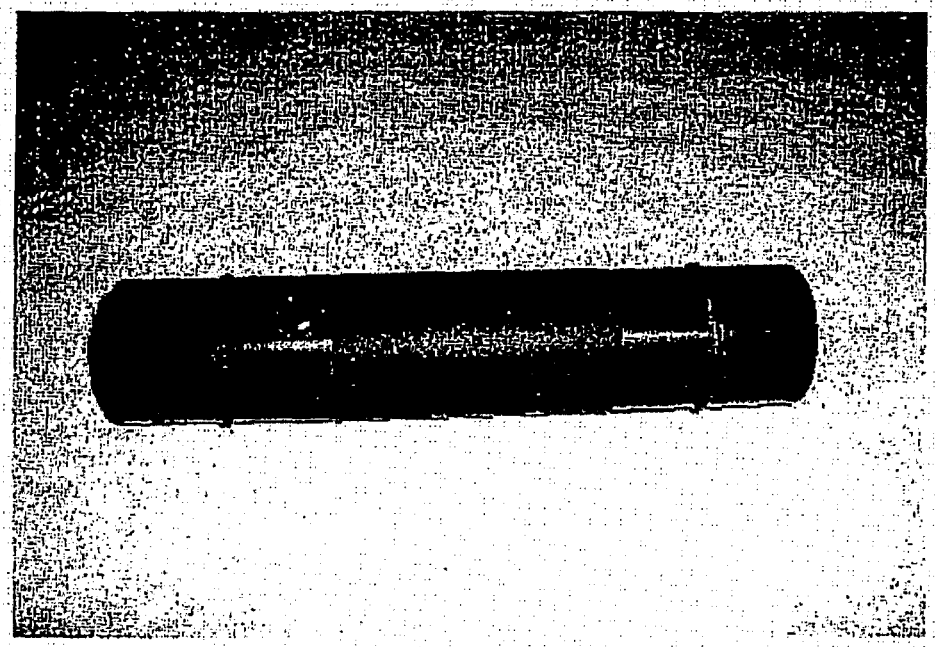

FIG. 7*a* shows an alternative embodiment of the portable torch 1 according to the invention seen from the second end of the torch. The torch 1 has a case 2 and a first end being closed with a first cap 3 and a second end being closed with a second cap 4. The second cap 4 is provided with connection means 5 for connecting a second battery-driven device to the portable torch 1, whereby the portable torch 1 serves as a battery-tank for the second battery-driven device. FIG. 7*b* shows the portable torch 1 seen from the first end of the torch. Thereby the transparent area 6 of the first cap 3 is shown. The transparent area 6 comprises seven recesses corresponding to seven diodes. In each recess a lens is located (not shown). The portable torch 1 further provides one switch 7 for controlling the function of the portable torch 1. In FIG. 7*c* the portable torch 1 is seen from the side showing the first cap 3, the second cap 4 as well as the switch 7.

Figure 8A:
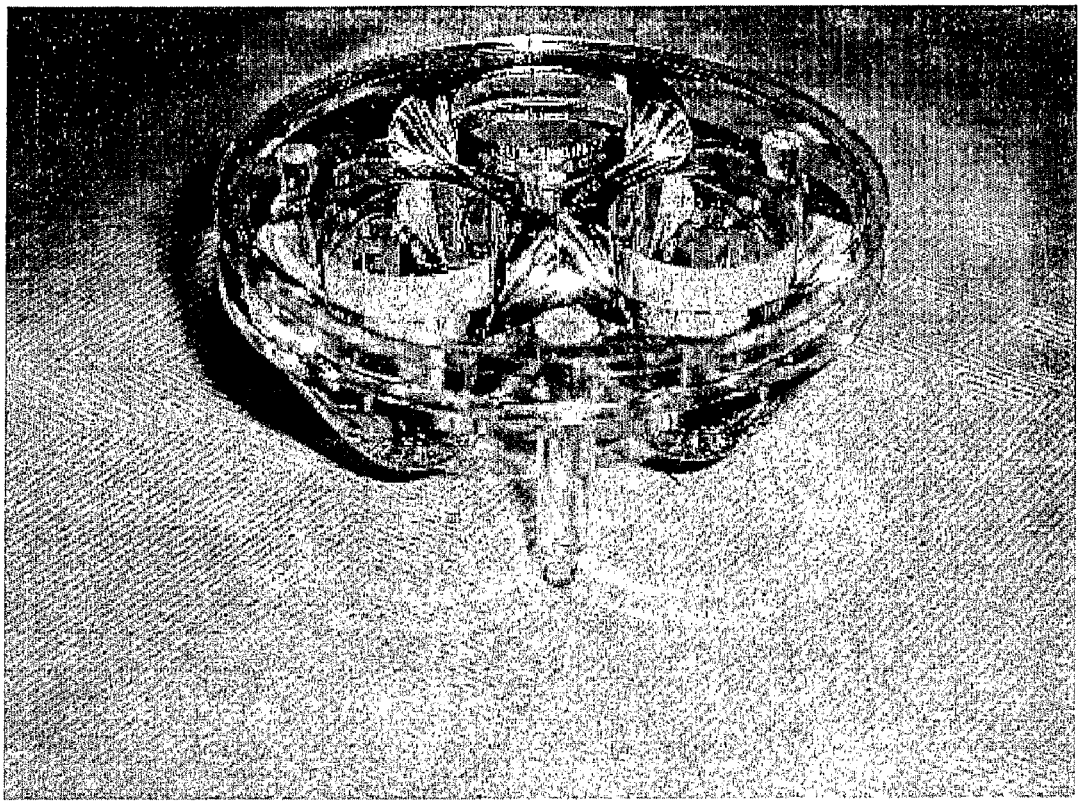
FIGS. 8*a* and 8*b* show the transparent area of the first cap of the portable torch of FIG. 7 with recesses comprising lenses.
Figure 8B:
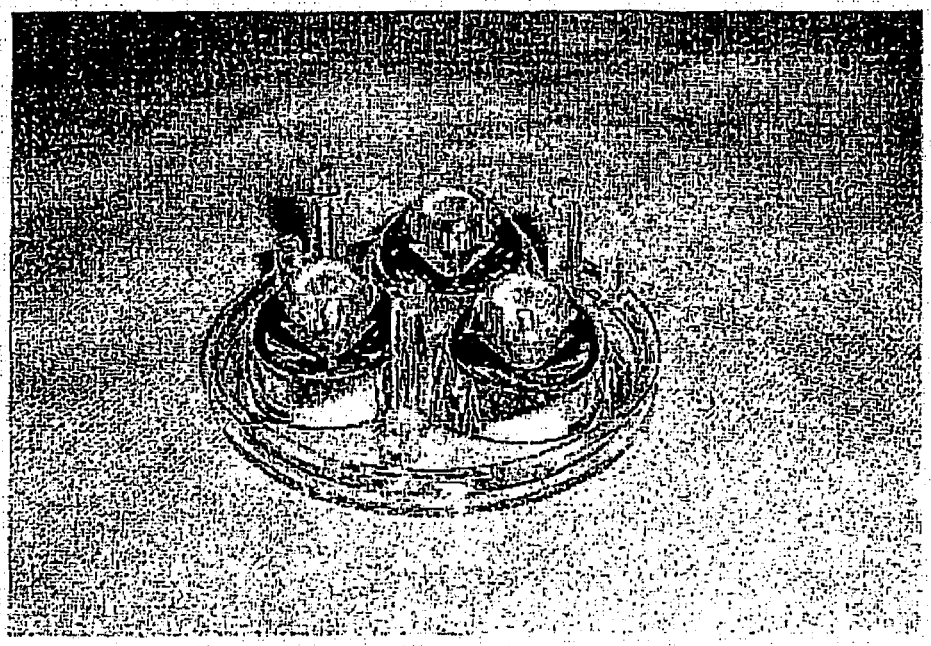

FIG. 8*a* shows the outer surface of transparent area 6 of the first cap. The transparent area 6 is provided with three recesses 9, a recess 9 for each diode of the portable torch. In the bottom of the recess 9 a lens 10 is provided. By arranging the lens 10 in a bottom of a recess 9, the risk for scratches on the lens 10 is minimized. The transparent area 6 is positioned in relation to a diode area (not shown) below the transparent area 6 by means of fastening rods 8. FIG. 2*b* shows the inner surface of the transparent area 6 of FIG. 2*a*. The lens 10 is shown positioned in the bottom of the recesses. Three fastening rods 8 are provided for positioning the transparent area 6.

Figure 9:
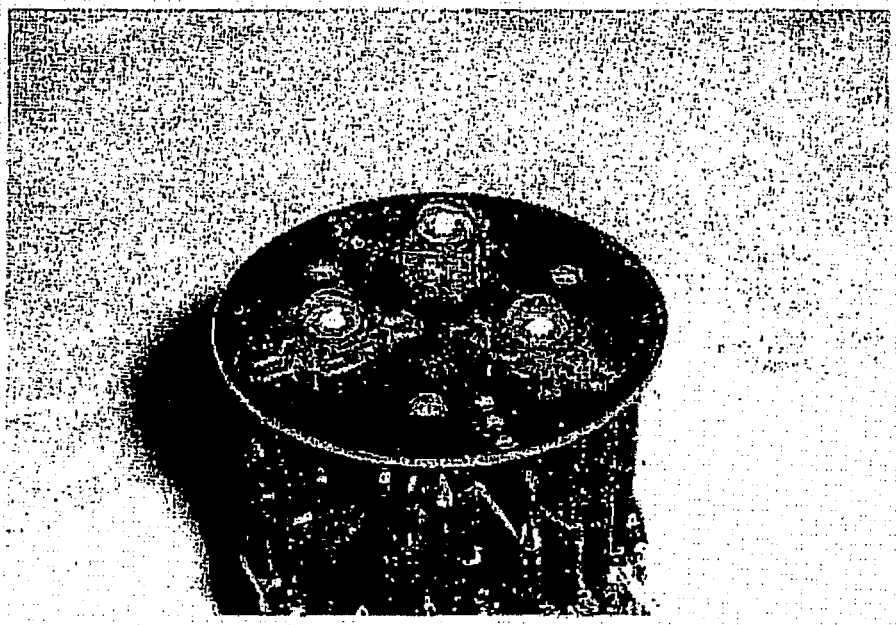
FIG. 9 shows the diode area of the portable torch of FIG. 7.

FIG. 9 shows a diode area 11 having three diode positions 12 for positioning diodes. Diodes are provided with power from the power source through circuit 13. A heat sink 14 is positioned below the diode area 11.

A cross section of the heat sink is shown in FIG. 13.

Figure 10:
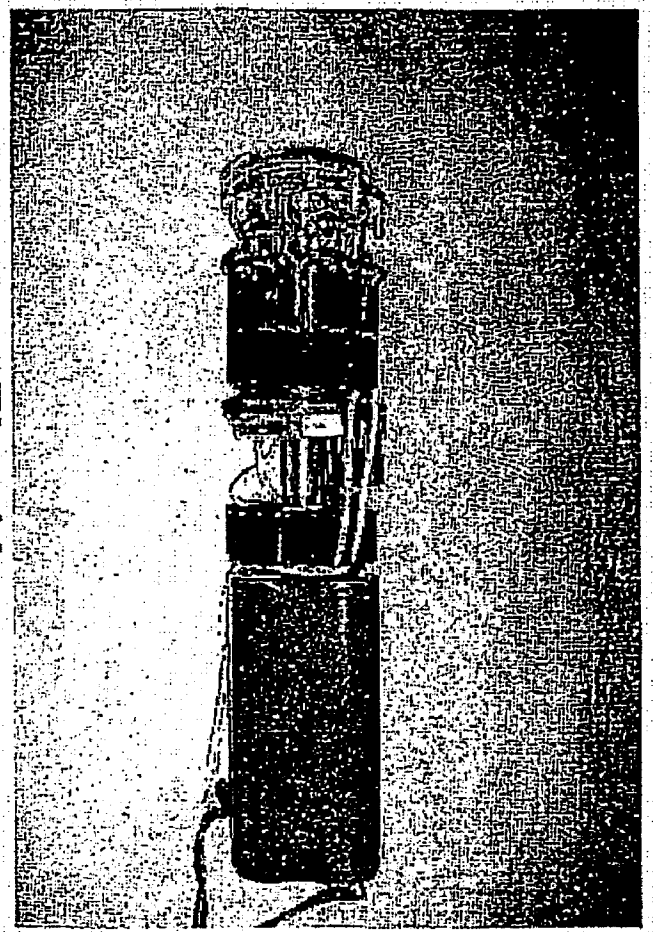
FIG. 10 shows the inner torch assembly of FIG. 7.

FIG. 10 shows the inner torch assembly 26 with the transparent area 6 of the first cap as one unit. The inner torch assembly 26 consists of diodes 18 positioned on the diode area 11. Below the diode area 11 are the two heat sink parts 14' and 14" spaced apart from each other. The two heat sink parts, 14' and 14", are connected through central rod 16. The battery unit 20 is attached through battery holder to the heat sink part 14". During assembling the inner torch assembly is inserted into the case of the portable torch through the first end of the portable torch. Once the inner torch assembly is in place the first cap and the second cap may be attached thereby closing the portable torch.

Figure 11A:
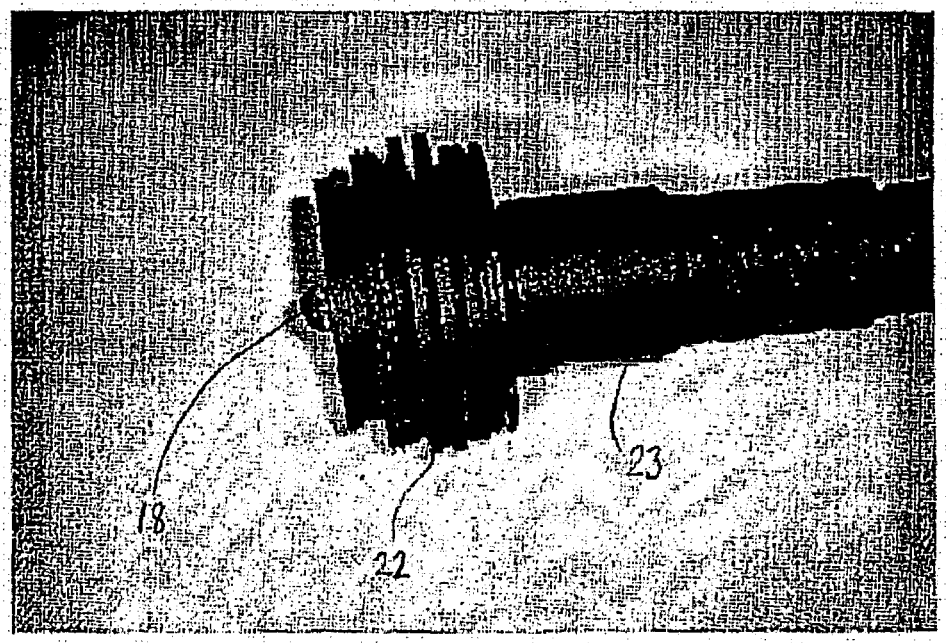
FIG. 11*a* shows tail-light socket with connector connected without transparent cap.
Figure 11B:
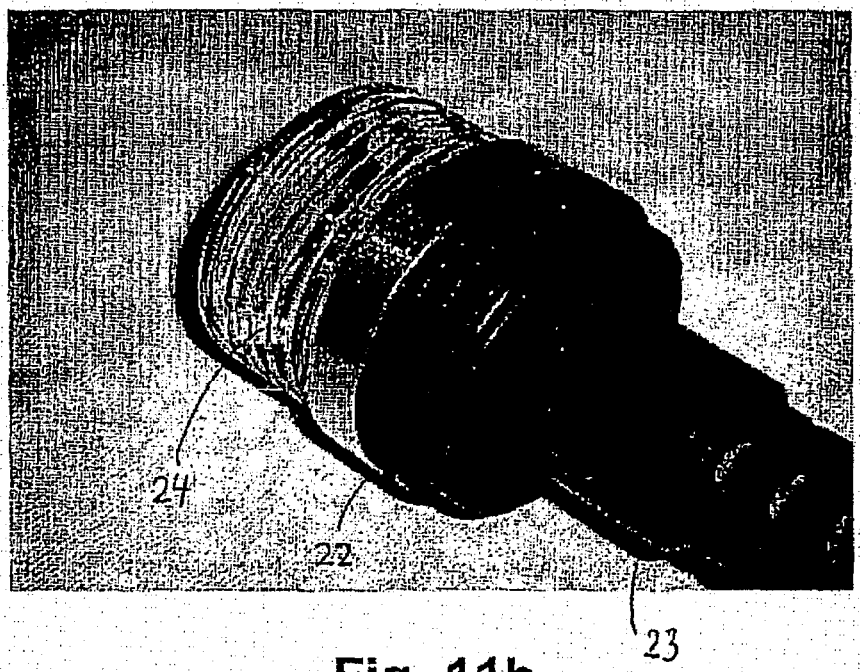
FIG. 11*b* shows the same with attached transparent cap.

FIG. 11*a* shows a tail-light socket 22 to be connected to the connection means of the second cap of the portable torch. The tail-light is battery-driven and provided with power from the battery of the portable torch. In the shown embodiment the tail-light is connected to the portable torch through a cable having connectors at both ends. Connector 23 is shown connected to the tail-light socket 22. Diode 18 is positioned centrally on the tail-light socket 22. FIG. 11*b* shows the tail-light socket of FIG. 11*a* wherein a transparent cap 24 is arranged to cover the diode on the tail-light socket 22. The connector 23 is preferably provided with small recesses for improving the grip.

Figure 12:
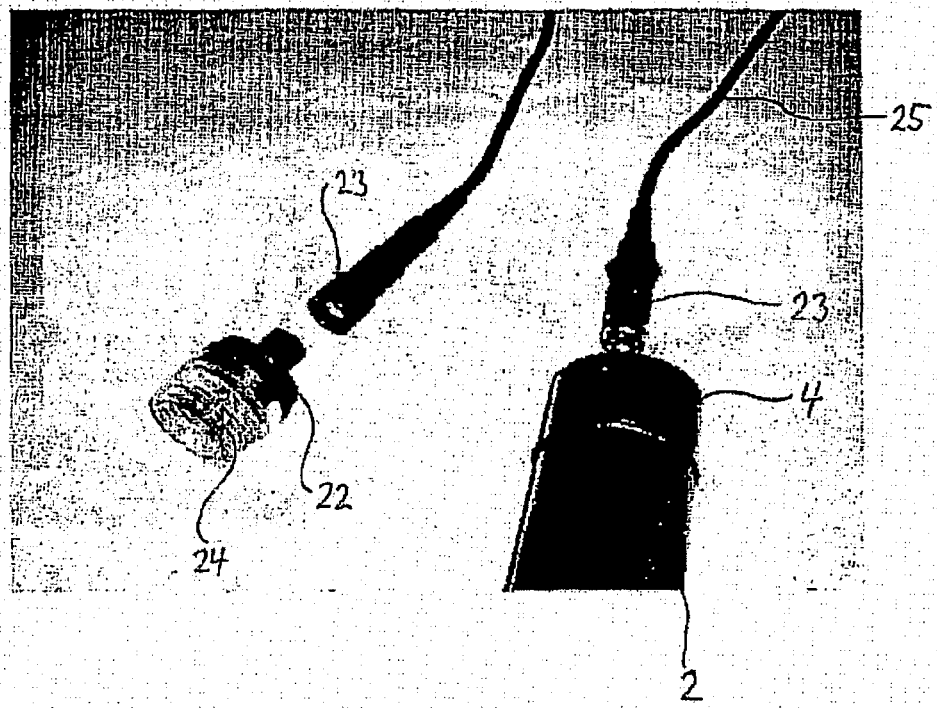
FIG. 12 shows the portable torch according to the invention with cable for connecting tail-light.

FIG. 12 shows a tail-light socket 22 with transparent cap 24, cable 25 with connectors 23' and 23" as well as the second end 4 of the portable torch. Connector 23' is connected to the tail-light socket 22 and connector 23" may be connected to the connection means of the second cap 4 of the portable torch. Thereby the tail-light may be used at a distance from the portable torch, such as positioned in a cap of the user, while still receiving power from the battery of the portable torch. The tail-light may be of any colour and/or function. Thereby the tail-light for example may be friend-foe identification while the portable torch as such serves as illumination source. The tail-light may also be strobing while the portable light has a continuous illumination source.

Figure 13A:
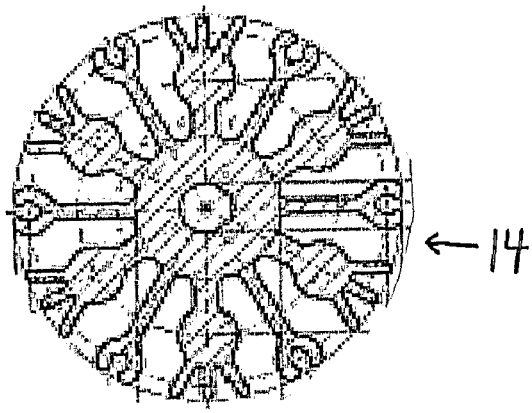
FIGS. 13*a* and 13*b* show alternative embodiments of a cross section of a heat sink.
Figure 13B:
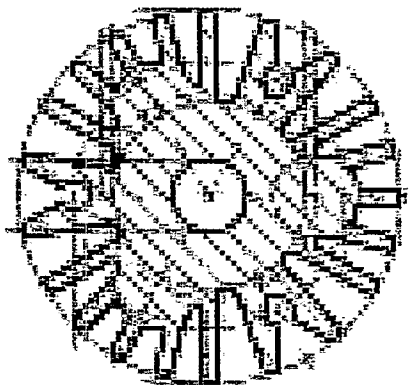

In FIG. 13*a* one embodiment of a heat sink cross section is shown. The heat sink 14 comprises a body part 29 connected to a variety of ribs 30. The heat sink 14 also comprises bearing surfaces 31 for the diodes, and a central hole 32 through which a central rod (not shown) may extend dissipating heat from the diode area to the heat sink 14. The heat sink 14 is furthermore provided with means 33 for fastening the printed circuit board to the heat sink 14 thereby providing a compact inner torch assembly. FIG. 13*b* shows an alternative embodiment of the heat sink 14, having body part 29, ribs 30, bearing surfaces 31 for the diodes, and a central hole 32 as well as means 33 for fastening the printed circuit board to the heat sink 14.

FIG. 14*a* shows the switch arrangement 27 in greater detail. Switch 7 is located in switch recess 38 in the switch arrangement 27. The switch 7 has a flange 42 to abut the floor 43 of the recess 38 to limit the insertion of the switch 7 into torch body. The switch 7 is held in place in the switch recess 38 by means of lock clips 34. The switch 7 is biased by means of spring 36 located beneath the switch 7. The switch arrangement 27 is waterproof due to a valve in the form of an O-ring 37 located in the well 35. FIG. 14*b* shows an exploded view of the switch 7 in greater detail.

FIG. 14*c* shows the switch during valve ventilation, wherein increase in pressure in the torch inner body forces the switch 7 outwords to the shoulder 40 of the lock clip. Thereby the O-ring 37 moves outwards as well allowing valve ventilation of the inner torch body.

In FIG. 14*d*, the switch arrangement of FIG. 14*a-c* is shown with the addition of magnet 41. Through magnet 41, it is possible to attach the torch to a surface. When the torch is attached to a surface, the switch 7 is pressed inwards thereby activating the power source.

Figure 15A:
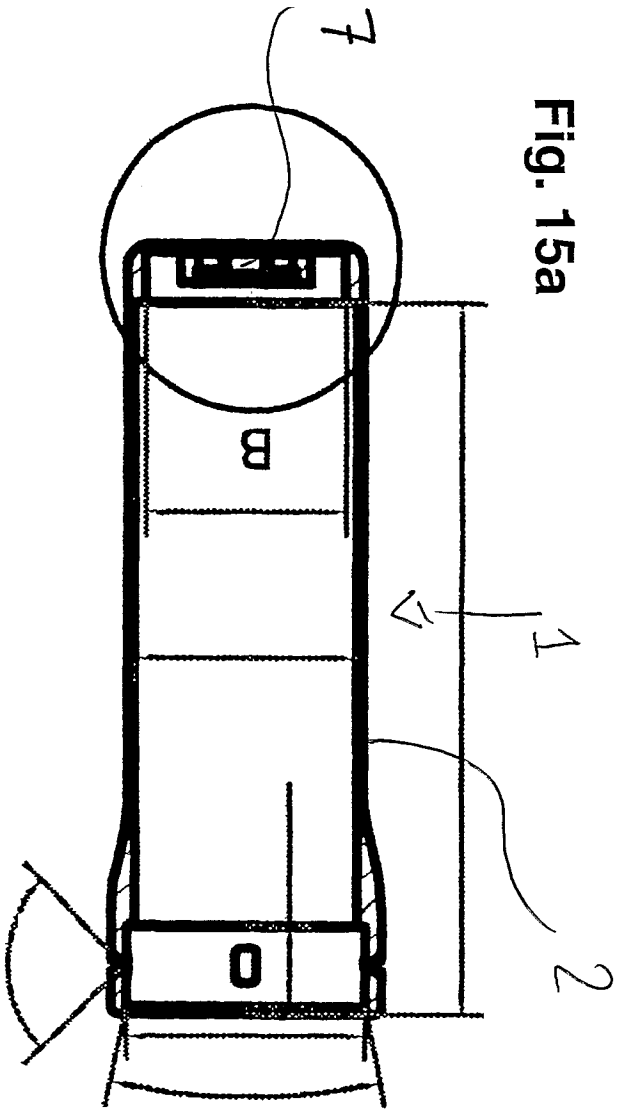
FIG. 15*a* shows a case for a battery-driven device having one open end.

In FIG. 15*a* shows the case 2 of a second battery-driven device having one open end for receiving a cap having a transparent diode area. In the closed end of the second battery-driven device one or more switches 7 may be arranged.

Figure 15B:
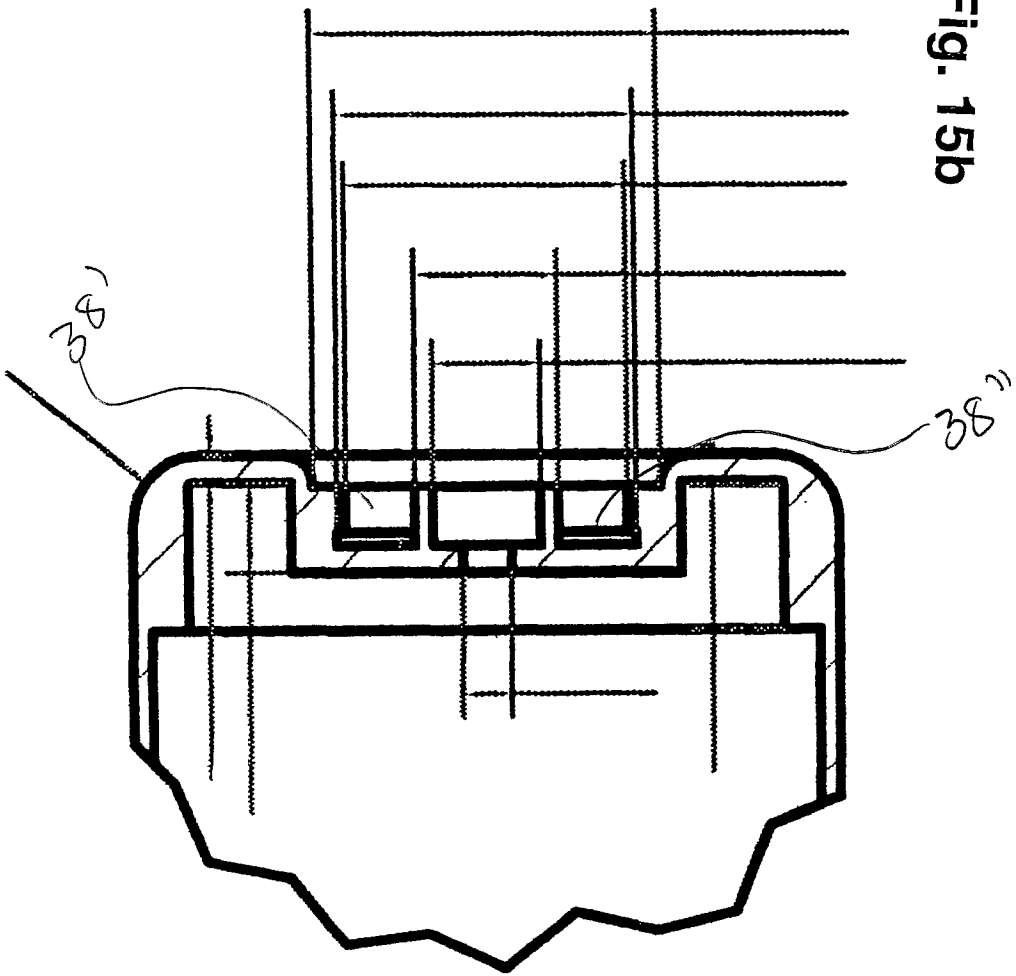
FIG. 15*b* shows a switch area for a battery-driven device having one open end.

FIG. 15*b* shows a more detailed drawing of the switches 7 of the case discussed in FIG. 15*a*. The switch 7 comprises switch recess 38', 38" as well as other details of the switch shown in FIG. 14*a-d*, including valve mechanism.

Figure 15C:
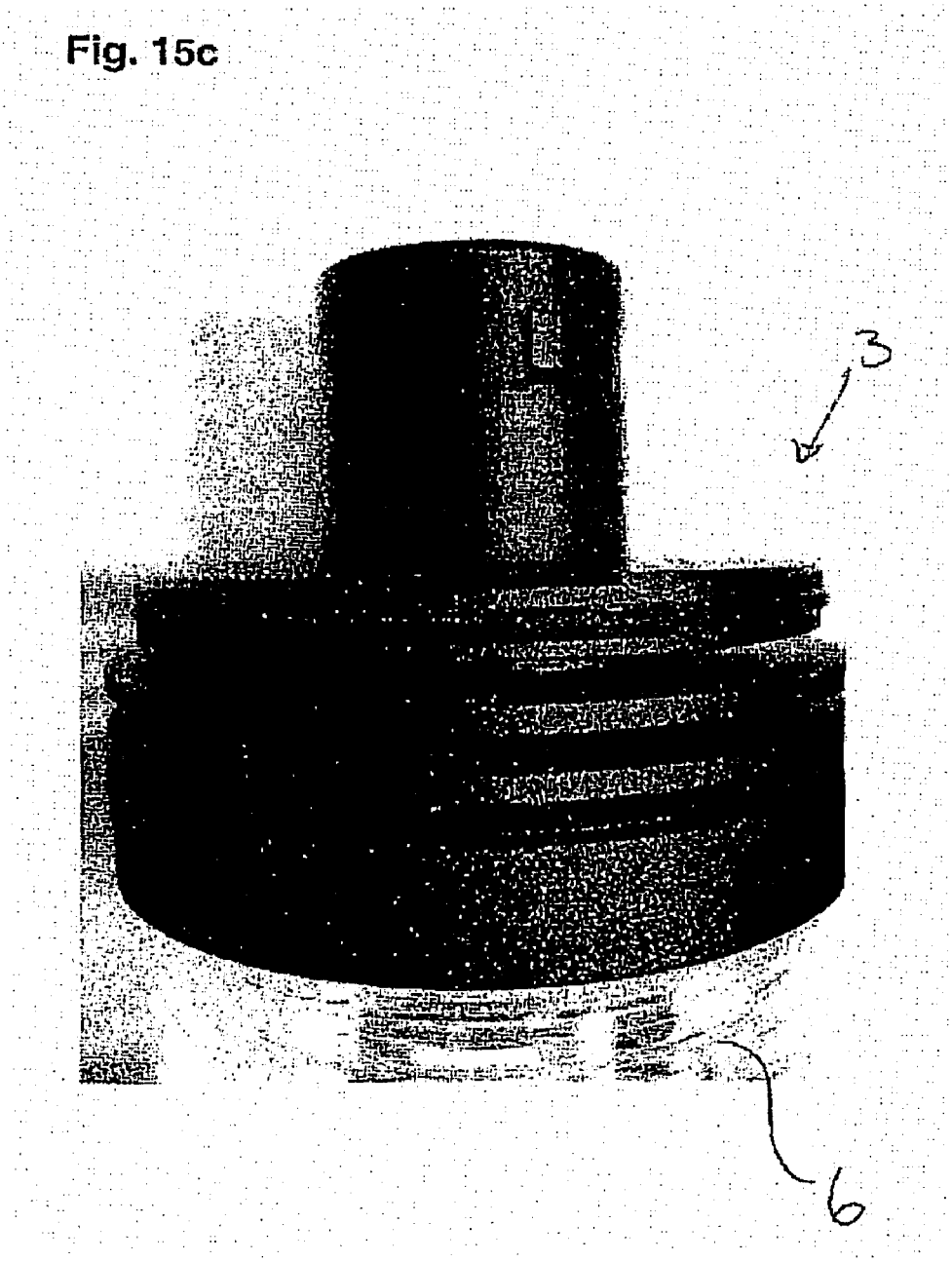
FIG. 15*c* shows a cap comprising a diode area adapted to fit into the open end of the case in FIG. 15*a*.

FIG. 15*c* shows a cap 3 for the battery-driven device of FIG. 15*a* comprising a transparent diode area 6. Said cap 3 is capable of fitting into the open end of the case 2 of the battery-driven device of FIG. 15*a*, as well as into the connection means of the second cap 4 of the portable torch. Thereby the cap 3 may be used with the portable torch as well as with the second battery-driven device.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

The invention claimed is:

1. A portable torch comprising a case having a first and a second open ends, a first cap covering the first open end and a second cap covering the second open end, said first cap having a transparent area, illumination means having a diode area comprising a plurality of light emitting devices (LEDs), one being a central diode, arranged to emit light out of the first open end and through the transparent area of the first cap, a heat sink system arranged to transport heat from the light emitting devices, wherein said heat sink system comprises a rod as a central part of a first material, wherein said material is copper, gold or silver or a metal or a metal alloy having a heat capacity and/or a heat conductivity as copper, gold or silver, wherein said central part is extending axially from the central diode, and two peripheral parts of a second material, said first material is different from said second material, and wherein said two peripheral parts are spaced apart from each other and connected through the central part, and wherein each of said peripheral parts is arranged with a plurality of radially extending parts, a power source comprising a battery holder, means for activating said power source operatively associated with said case.

2. The portable torch according to claim 1, wherein the illumination means comprises at least three LEDs arranged and the heat sink is connected to the diode area through a central thermally conducting rod.

3. The portable torch according to claim 1, wherein the illumination means comprises at least seven LEDs arranged as one central LED and at least six surrounding LEDs.

4. The portable torch according to claim 1, wherein the distance between the center of a central LED and the center of a neighbouring LED is at most 2.1 cm.

5. The portable torch according to claim 1, wherein the height of the heat sink is at least 1.0 cm.

6. The portable torch according to claim 1, wherein one heat sink transports heat from more than one LED in the torch.

7. The portable torch according to claim 1, wherein the heat sink comprises at least two parts connected through a rod of thermally conducting material.

8. The portable torch according to claim 1, wherein the heat sink comprises a core of heat sink material beneath each LED.

9. The portable torch according to claim 1, wherein the heat sink is made from a material selected from the group of material consisting of Aluminium, Copper, Silver, Platinum, and Gold.

10. The portable torch according to claim 1, wherein the central rod includes at least a part of the battery holder.

11. The portable torch according to claim 1, wherein the heat sink has ribs.

12. The portable torch according to claim 1, wherein the LEDs are arranged on a support with socket means for providing electrical power between the power source and the LEDs.

13. The portable torch according to claim 1, wherein the optical axis of a first LED and the optical axis of a second LED are parallel.

14. The portable torch according to claim 1, wherein at least one lens is arranged in the light path from a LED.

15. The portable torch according to claim 1, wherein a lens is arranged in the light path from each LED.

16. The portable torch according to claim 1, wherein lenses are arranged so that light from at least two LEDs converge.

17. The portable torch according to claim 1, wherein lenses are arranged so that light from at least two LEDs diverge.

18. The portable torch according to claim 1, wherein the torch is capable of functioning as a battery-tank for a second battery-driven device.

19. The portable torch according to claim 18, wherein a second cap comprises means for connecting a second battery-driven device.

20. The portable torch according to claim 19, wherein the power source supplies power to the illumination means and to the battery-driven device connectable to the second cap.

21. The portable torch according to claim 20, including a controller for activating the power supply to the illumination means independent from activating the power supply to the second battery-driven device connectable to the second cap.

22. The portable torch according to claim 21, wherein the controller includes means for monitoring the device connected to the second cap.

23. The portable torch according to claim 21, wherein the control means includes feedback means for measuring temperature of LEDs and means for regulating light intensity of the LEDs.

24. The portable torch according to claim 20, wherein a cap comprising a diode area of the battery-driven device is connectable to the second cap.

25. The portable torch according to claim 20, wherein the battery-driven device connectable to the second cap may be a flash light, a second torch, a coloured light, an ultraviolet light, or an infrared light.

26. The portable torch according to claim 19, wherein the first cap and the second cap is releasably connected to the case.

27. The portable torch according to claim 19, wherein the first and the second cap are sealingly connected to the case.

28. The portable torch according to claim 1, further comprising control means for maintaining a substantially constant light output from the illumination means.

29. The portable torch according to claim 1, wherein the activating means comprises at least two waterproof buttons and waterproof connections to the power supply.

30. The portable torch according to claim 1, wherein at least a part of the case is covered with an elastomeric coating.

31. A modular kit, said kit comprising at least one portable torch as defined in claim 1, and at least one second battery-driven device, wherein said second battery-driven device is capable of being connected to the portable torch.

32. The modular kit according to claim 31, wherein the portable torch is capable of functioning as a battery-tank for a second battery-driven device.

33. The modular kit according to claim 31, wherein a second cap of the portable torch comprises means for connecting the at least one second battery-driven device.

34. The modular kit according to claim 31, wherein the power source of the portable torch supplies power to the illumination means of the portable torch and to the second battery-driven device connectable to the portable torch.

35. The modular kit according to claim 31, including a controller for activating the power supply to the illumination means of the portable torch independent from activating the power supply to the second battery-driven device connectable to the portable torch.

36. The modular kit according to claim 35, wherein the controller includes means for monitoring the device connected to the portable torch.

37. The modular kit according to claim 31, wherein a cap comprising a diode area of the battery-driven device is connectable to the second end of the portable torch.

38. The modular kit according to claim 31, wherein the second battery-driven device connectable to the portable torch may be a flash light, a second torch, a coloured light, an ultraviolet light, or an infrared light.

* * * * *